United States Patent [19]

John, deceased et al.

[11] Patent Number: 4,543,696

[45] Date of Patent: Oct. 1, 1985

[54] DEVICE FOR SEPARATING AND DELIVERING INDIVIDUAL HEDDLES OR DROP WIRES TO A DRAW-IN POSITION

[75] Inventors: Heinz John, deceased, late of Berneck; by Friedlinde John née Rueffler, Heir, Gams, both of Switzerland

[73] Assignee: Lindauer Dornier Gesellschaft mbH, Lindau, Fed. Rep. of Germany

[21] Appl. No.: 430,286

[22] Filed: Sep. 30, 1982

[30] Foreign Application Priority Data

Oct. 6, 1981 [DE] Fed. Rep. of Germany ..... 3139626

[51] Int. Cl.[4] ..... D03J 1/14

[52] U.S. Cl. ..... 28/206

[58] Field of Search ..... 28/205, 206, 207; 209/636, 907

[56] References Cited

U.S. PATENT DOCUMENTS

| | | | |
|---|---|---|---|
| 3,653,106 | 4/1972 | Fleischer | 28/206 |
| 3,744,109 | 7/1973 | Dohi et al. | 28/206 |
| 3,777,339 | 12/1973 | Fleischer et al. | 28/206 |
| 4,047,270 | 9/1977 | Heinz | 28/205 |

FOREIGN PATENT DOCUMENTS

| | | | |
|---|---|---|---|
| 2228690 | 12/1972 | Fed. Rep. of Germany . | |
| 2222326 | 12/1973 | Fed. Rep. of Germany | 209/636 |
| 2339586 | 6/1977 | Fed. Rep. of Germany . | |
| 485056 | 2/1968 | Switzerland . | |
| 810908 | 3/1959 | United Kingdom | 28/205 |
| 2109426 | 6/1983 | United Kingdom | 28/207 |

*Primary Examiner*—Robert R. Mackey

*Attorney, Agent, or Firm*—W. G. Fasse; D. H. Kane, Jr.

[57] ABSTRACT

The invention relates to a device for individually separating heddles arrayed in a pack on slide rails. It is assumed that the heddles are of a magnetizable material. One magnetic plate is mounted at each of the opposite sides of the pack, these plates being polarized in opposite directions whereby they exert a repelling action. The foremost elements of the pack are split from one another by the magnetic action and are positioned with a significant mutual spacing between the pair of magnetic plates. The pair of magnetic plates evinces a flaring field distribution in the direction of advance of the heddles.

4 Claims, 5 Drawing Figures

DEVICE FOR SEPARATING AND DELIVERING INDIVIDUAL HEDDLES OR DROP WIRES TO A DRAW-IN POSITION

FIELD OF THE INVENTION

The invention relates to a device for individually separating narrow elongated elements tightly arranged on guide means or slide rails. More specifically, the invention relates to a device for separating and delivering individual heddles or drop wires to a draw-in position.

DESCRIPTION OF THE PRIOR ART

Such devices are used to separate heddles in warp thread draw-in machinery for looms. The heddles lying on the heddle frames in a tightly packed group or row or abutting each other can be separated thereby and lifted from one another. The separated and removed heddles in this manner arrive at a predetermined draw-in position, with the heddle eye for passing the warp thread being moved into the pertinent required position.

U.S. Pat. Nos. 2,175,910 and 3,103,056, and Swiss Pat. No. 485,056 do disclose such separation devices. As regards the device in the last cited document, which refers to the former two, a worm is rotatably supported about a spindle parallel to the path of motion of the objects, i.e., handles, at the end of the pack. The worm is divided into a screw-like groove receiving one object, i.e., a heddle, and moving this object forward along the worm when there is rotation. The object, or the heddle, arrives thereby in the pitch of the worm, i.e., in the groove, which corresponds to the heddle width, this heddle then being rotated into the proper position for receiving the thread and then released.

Moreover, German Offenlegungsschrift No. 2,228,690, discloses a device for separating heddles, where the individual heddles are lifted from one another electromagnetically, in lieu of the heretofore used permanet magnets, this device including control means so designed that they feed a relatively weak magnetizing current to the electromagnet when it is in the initial phase of its motion away from the row of heddles and a relatively strong magnetizing current in the following phase of its motion.

The separation devices known from U.S. Pat. Nos. 3,103,056 and 2,175,810 and from Swiss Pat. No. 485,056 incur the drawback of being costly in manufacture and suitable only for special design heddles as regards the thread-receiving eyes. The device of German Offenlegungsschrift No. 2,228,690 entails the drawback that each separating means comprises only one withdrawal magnet, whereby there is a danger of warping and hence of the catching of the heddles at the heddle slide bars. Another drawback is the requirement for a precise metering of the magnetic force of the withdrawal magnet when removing the first heddle from the pack of heddles and hence the need for limiting the withdrawal force.

German Auslegeschrift No. 2,339,586 further discloses a device for separating heddles. In this case, the first heddle of a pack of heddles or drop wires resting on support rails is lifted by two suction nozzles of this pack and then is held by magnetic force and moved into the draw-in position for the warp thread. The suction nozzles are mounted to the ends of two tubular conduits bent around in the manner of a walking cane, the tubes being displaceable parallel to the packs and rotatable about their longitudinal axes. The suction nozzles therefore can be pivoted from the side into the advance path of the heddles and can be placed in front of the first heddle of the pack. The first heddle is lifted by suction, possibly reinforced by a slight magnetic force from an auxiliary magnet mounted to the nozzle, and is removed from the pack by longitudinally displacing the tube and is moved into the range of a more powerful magnet which displaces the heddles in fully reliable manner into the threading-in position and there keeps it for the time of threading of the warp thread. After the warp thread has been threaded into the heddle, the bent ends of the tube together with the suction nozzles there mounted and also the magnetic means are pivoted back and withdrawn into their initial position.

The last-cited device however on occasion is still beset by shortcomings, because in spite of precise metering of the suction effect and/or the magnetic force, it can occur that more than a single heddle will be lifted off of the pack, namely sometimes two and even more heddles stick to each other and are raised together by the suction effect or magnetic attraction and are moved together. Moreover, it is necessary to provide the suction nozzles and magnetic means in pairs in order to achieve as uniform as possible a withdrawal effect over the length of the heddle and to prevent warping.

SUMMARY OF THE INVENTION

It is therefore the object of the present invention to so improve devices of the above-cited type for separating narrow, elongated elements tightly arrayed on guide means, for instance heddles or drop wires, that problem-free individual separation of the elements is possible. The solution of the invention resides in making the elongated elements at least partially of a magnetizable material and in that on both sides of the magnetizable part there is arranged a pair of magnetic plates with a polarization transverse to the longitudinal direction of the elements and also to their direction of advance on the guide means, and in that these plates be of opposite polarities. The advance direction is also referred to as delivery direction.

Advantageously, the magnetic plates are so designed that their field strength is increasing in the delivery direction whereby spacings between adjacent elongated elements increase in said delivery direction. This feature can be achieved by a plate shape widening in the direction of delivery or advance, for instance by a triangular form, one of the sides of the triangle facing in the direction of advance and a triangle corner pointing in the direction opposite to the delivery direction. Permanent magnets or correspondingly shaped electromagnets are suitable for the present purpose.

The arrangement of the lateral magnetic plates achieves that not only the uppermost of the pack elements, but rather a certain number of elements will be individually separated. Due to the action of the magnetic field, the separated elements distribute themselves over the lengthwise extension of the magnetic plates in such a manner that the individual elements assume a significant spacing with respect to each other. The spacings between two consecutive elements increase according to the field distribution at the end of the pair of magnetic plates in the direction of advance. In this manner, the elements are already separated individually before being consecutively seized one by one by known means and are moved into the predetermined position, for instance the draw-in position for heddles. Because the elements, heddles or the like are already loosened by the magnetic plates and are readied, the lifting proper from the pack and the further displacement take place in a problem-free manner using one of the above-cited known methods, for instance suction nozzles or magnetic means. To achieve the desired effect, only one pair of magnetic plates is required. It can be mounted, for instance, at the upper part of the elements or heddles.

However, in special cases, a further pair of magnetic plates can be provided, for instance at the bottom of the elements. If desired, the pairs of magnetic plates are arranged in a displaceable manner parallel to the direction of advance or displacement of the elements in order to maintain the pairs of magnetic plates always at the beginning of the pack, whereby the first elements always will be separated from the beginning of the pack. It suffices with respect to the function of the invention that the elements be at least magnetizable in their part which is located within the range of the pair of magnetic plates. As the heddles generally are made of steel, they require no special steps to be individually separated or loosened in accordance with the invention.

BRIEF DESCRIPTION OF THE DRAWINGS

An embodiment of the invention is illustratively described below in relation to the drawings, in which.

DETAILED DESCRIPTION OF PREFERRED EXAMPLE EMBODIMENTS AND OF THE BEST MODE OF THE INVENTION

Figure 1:
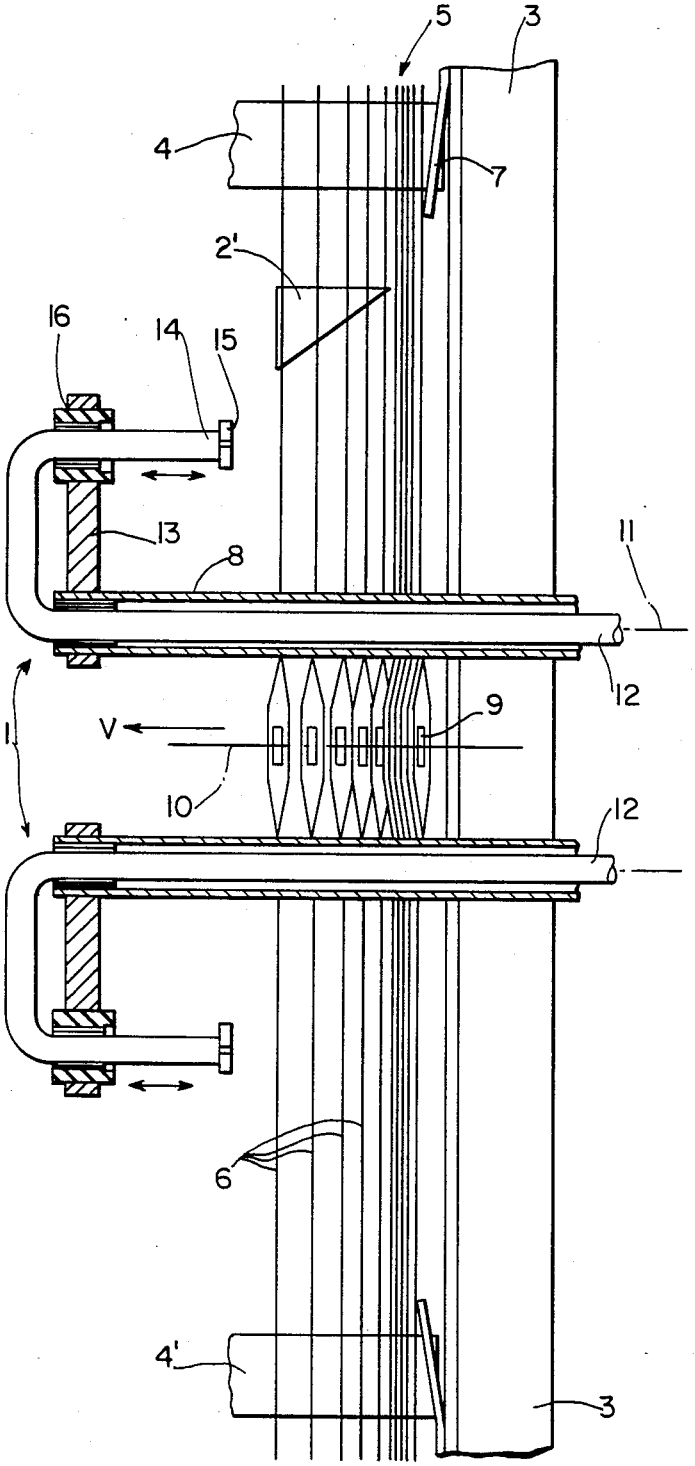
FIG. 1 is a side view of the device.
Figure 2:
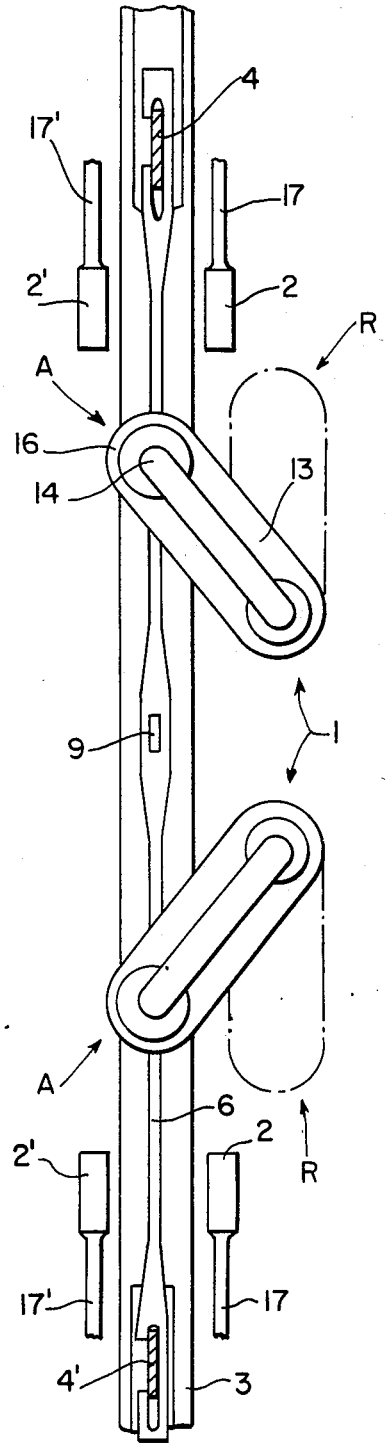
FIG. 2 is a front view of the device of FIG. 1.

First, the overall construction of the device will be described in relation to FIGS. 1 and 2. An example of tightly arranged elongated elements, in this case heddles, is selected, which are arrayed on slide rails in a frame.

An upper and lower heddle slide or guide rail 4 and 4' respectively, are mounted in a partially shown heddle frame 3. Both guide rails 4, 4' together define a feed advance plane extending vertically between the guide rails 4, 4' and in an advance direction V. Individual heddles or drop wires 6 are arrayed on these heddle slide rails and are combined into a pack 5 at the frame 3 against which they rest, i.e., where they abut against the leaf springs 7. A widening with the heddle eye 9 can be seen at the center of the heddles 6. Each heddle 6 has a long axis extending from one slide rail 4 to the other slide rail 4', a width extending perpendicularly to the advance direction V, so that a flat side of a heddle faces in the advance direction V, and a thickness extending in the advance direction V. Two devices 1 to individually separate the heddles are mounted symmetrically to the axis 10 passing through the heddle eyes 9. These devices 1 are substantially of the same design, so that only one of them is provided with a reference numeral. The devices 1 are composed of guide tubes 8 within each of which is mounted one suction tube 12 which is rotatable and longitudinally displaceable. These tubes 12 extend from their beginning (not shown) outside the heddle frame 3 laterally past the pack 5 of heddles and are bent in a U-shape, i.e, in the manner of a walking cane, at their ends. An arm 13 is mounted at the end of the guide tube 8 to support the bent end 14 of the tube 12. The tube end 14 is provided with a suction nozzle and possibly, it also additionally includes a weak suction nozzle magnet 15 to reinforce the nozzle suction, if needed. The tube end 14 together with the suction nozzle magnet 15 is opposite the pack 5 and extends parallel to the heddle slide rails 4 of the heddle frame 3, that is, it is also parallel to the direction of advance V of the heddles. Somewhat more powerful magnetic holding means 16 are mounted at the end of the arm 13. The tube 12 is not only rotatable about its axis 11, with the bent end 14 being pivoted from the rest R position shown in dash-dot lines in FIG. 2 into the operational position, rather it also can be advanced or retracted in its longitudinal direction relative to the guide tube 8 and the arm 13. This longitudinal displaceability is indicated by a bidirectional arrow at the tube end 14.

A pair of magnetic plates is mounted in the vicinity of the upper heddle slide rail 4 on both sides of the pack 5, that is, on both sides of the arrayed heddles 6. The two magnetic plates are denoted by 2 and 2'. They are supported in a manner not shown in further detail, for instance by two holding means 17 and 17' respectively. The pair 2,2' of magnetic plates evinces a shape flaring in the direction of advance V. A triangular form is illustratively selected in the figures. If required, a corresponding pair of magnetic plates also can be mounted in the vicinity of the lower heddle slide rail 4'.

Figure 3:
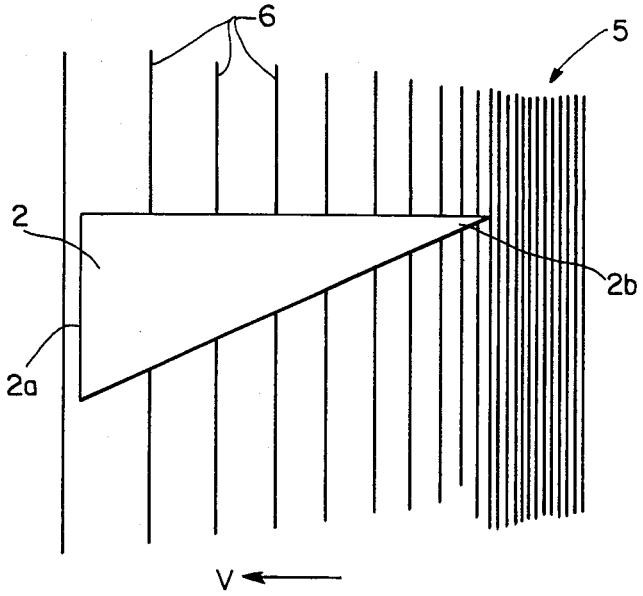
FIG. 3 is a partial view of FIG. 1 on a larger scale.
Figure 4:
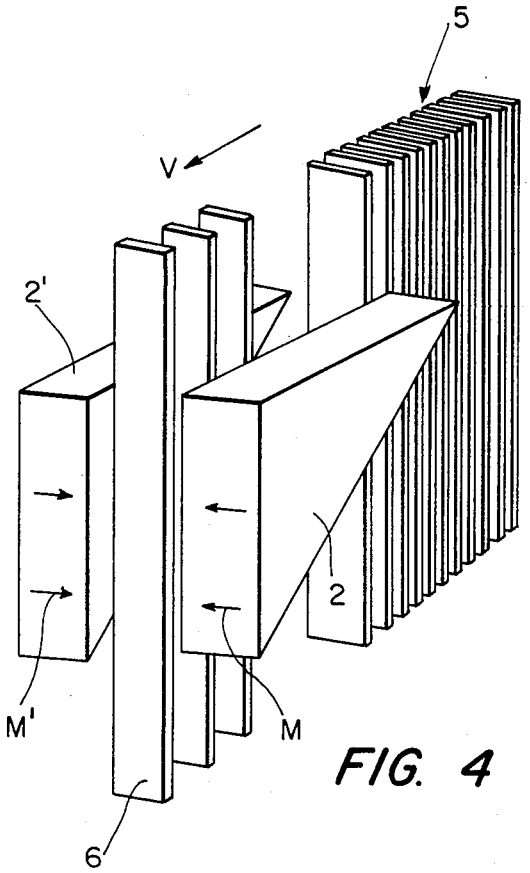
FIG. 4 is a perspective of FIG. 3.

FIG. 3 shows the shape and the arrangement of the pair 2, 2' of magnetic plates on a somewhat larger scale. The shape flaring in the direction of advance V is clearly shown. The magnetic plate 2 begins at the pack 5 with a vertex **2*b* and widens triangularly in the direction of advance V. The triangle side 2*a* faces in the direction of advance. The spacings between neighboring heddles 6 grown progressively larger with an increasing distance from the heddle pack 5. The same arrangement is shown in the perspective view of FIG. 4. FIG. 4 furthermore shows the direction of magnetization of the pair 2, 2' of magnetic plates in the form of small arrows. The magnetization M and M' is transverse to the plates 2, 2', that is, the direction of magnetization is both transverse to the direction of advance V and to the thickness of the pack of heddles 6. It is important moreover for the invention that the magnetization of the two magnet plates 2, 2'** be opposite. This is indicated by the directional arrows M and M'. As a result the two magnetic plates will exert a repelling effect.

Figure 5:
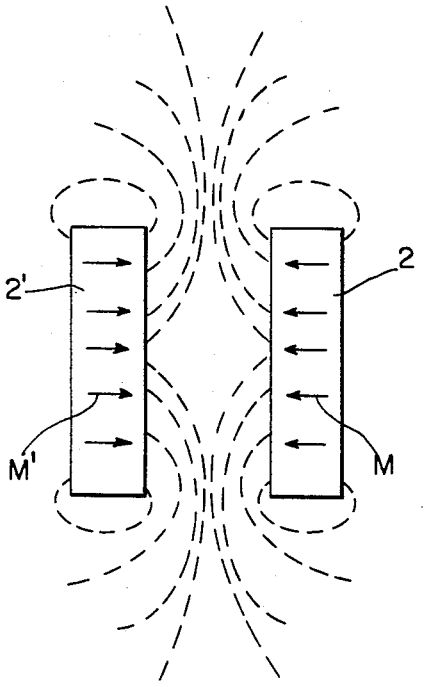
FIG. 5 is a partial view of FIG. 2 on a larger scale with drawn-in magnetic lines of force.

FIG. 5 shows the two magnetic plates 2, 2' as seen from their narrow side and the direction of polarization M and M' again is shown by arrows. The magnetic field lines are indicated in dashed lines. Each magnetic plate 2, 2' has a surface in parallel to said feed advance plane and in parallel to the respective other facing surface. Both facing surfaces have the same magnetic polarization so that the respective magnetic forces oppose each other across the feed advance plane as shown in FIG. 5. Due to this magnetic repulsion on the one hand and due to the field increasing in the direction of advance V on the other hand, the foremost heddles 6 are lifted from the pack 5 and moved between the pair 2, 2' of magnetic plates in the direction of advance, evincing a clear mutual spacing. Because of the field distribution, the spacing between consecutive heddles even increases in the direction of advance, whereby the two heddles 6 at the front are farthest apart. The moment the magnetic force becomes effective, the foremost heddles evince the distribution approximately shown in FIGS. 3 and 4 and remain in this arrangement, where the foremost heddle is located approximately at the end of the pair 2, 2' of the magnetic plates. In this manner, the foremost heddle 6 can be easily seized by, for instance, suction and removed, the procedure preventing any heddles 6 from adhering to each other and being lifted together and moved together into the thread draw-in position.

The device works as follows. The pair 2, 2' of magnetic plates is moved toward the bunched pack 5. As soon as the pack 5 comes into the effective range of the pair 2, 2' of magnetic plates, the foremost heddles 6 are separated from and loosened from the pack 5, whereby the heddles 6 are placed in a position with a clear mutual spacing between them. The suction tube 12 in that case will be approximately in its operational position A shown in FIGS. 1 and 2. Thereupon, the suction tube 12 is withdrawn within its support in arm 13 opposite the direction of advance V until the bent tube end 14 together with its suction nozzle or with any suction nozzle magnet 15 mounted at the tube end comes to rest against the foremost heddle 6. This heddle is aspirated by the suction nozzle, possibly with reinforcement by attraction from the suction nozzle magnet 15, and accordingly it is seized by the separating device 1. Thereupon, the suction tube 12 is again advanced in the direction of advance V, with the arm 13 initially remaining stationary. The tube end 14 together with its suction nozzle magnet 15 then comes to lie in a clearance of the arm 13 where a holding magnet 16 is provided. This holding magnet 16 is somewhat more powerful than the suction nozzle magnet 15 and henceforth on its own assumes the function of holding the lifted heddle 6. Next, the entire separating device 1 is advanced in direction V into a draw-in position (not shown) where the pertinent warp thread is drawn into the heddle eye 9. The threaded heddle is released by the separation device 1 which now can be pivoted back into its rest position R. The suction tube 12 with the guide tube 8 and the arm 13 are retracted together opposite the direction of advance V past the presently threaded heddle 6 as far as the pack 5. By again pivoting into the operational position A and by displacing the tube end 14 with the suction nozzle magnet 15, the next heddle 6 is removed, which, after the removal of the previous heddle had automatically slipped into the foremost position at the pair of magnetic plates on account of the magnetic force. In this manner, precisely one heddle is advanced each time to be presented to the separation and warp thread draw-in system.

It will be appreciated by those skilled in the art that many modifications may be made within the scope of the present invention without departing from the spirit thereof, and the invention includes all such modifications.

What I claim is:

1. In an apparatus for picking up individual heddles (6) from a pack (5) of heddles having a long axis, a width, and a thickness and for delivering an individual heddle in an advance direction (V) to a draw-in zone for threading, including means for individually separating said heddles from said pack of heddles and for individually delivering each separated heddle to said draw-in zone, comprising guide means including upper and lower guide rails (4, 4') for holding said heddles so that said width of said heddles extends substantially perpendicularly to said advance direction, said guide rails preventing rotation of said heddles about said long axis, said guide rails defining a feed advance plane extending substantially vertically between said upper and lower guide rails (4, 4') and in said advance direction (V), said means for separating including at least two stationary magnetic plates (2, 2') forming a pair, means (17, 17') operatively mounting one of said magnetic plates on one side of said pack of heddles and the other magnetic plate opposite said one magnetic plate on the other side of said pack of heddles so that both magnetic plates extend in parallel to each other and on opposite sides of said feed advance plane to form a gap of constant width, each magnetic plate having a heddle thickness facing surface in parallel to said feed advance plane, said facing surfaces extending in parallel to each other, both facing surfaces having the same magnetic polarization so that the respective magnetic forces oppose each other across said feed advance plane, and so that said magnetic forces extend substantially perpendicularly to said length axis, each of said heddles having at least one magnetically responsive portion located for cooperation with said pair of magnetic plates, each of said magnetic plates having a shape which widens in said advance direction (V) and in parallel to said feed advance plane for providing a magnetic field strength which increases in said advance direction, whereby said magnetic plates cause said heddles to individually separate from said pack of heddles in said advance direction with spacings between neighboring heddles growing progressively larger with an increasing distance from said pack of heddles.

2. The apparatus of claim 1, wherein said shape of said magnetic plates is triangular whereby a triangle side faces in said advance direction and a triangle corner points in a direction opposite to said advance direction.

3. The apparatus of claim 1, comprising a further pair of magnetic plates arranged relative to said pack of heddles in the same manner as said first mentioned pair of magnetic plates but longitudinally spaced in the direction of said long axis from said first mentioned pair of magnetic plates.

4. The apparatus of claim 1, wherein said pair of magnetic plates are movably mounted for displacement substantially in parallel to said feed advance plane for placing said magnetic plates relative to said pack in such a position that always the foremost, as viewed in the advance direction, heedles are separated from said pack of heddles.

* * * * *